United States Patent [19]

De Guzman

[11] Patent Number: 4,917,975

[45] Date of Patent: Apr. 17, 1990

[54] CONTAMINATION CONTROL MATS AND METHODS AND APPARATUS FOR REMOVING SHEETS THEREFROM

[76] Inventor: Joselito S. De Guzman, 3807 W. 119th Pl., Hawthorne, Calif. 90250

[21] Appl. No.: 306,333

[22] Filed: Feb. 3, 1989

[51] Int. Cl.[4] ..... B32B 3/02; F23J 0/00

[52] U.S. Cl. ..... 428/81; 15/104 A; 15/215

[58] Field of Search ..... 15/104 A, 215; 428/81, 428/40, 45

[56] References Cited

U.S. PATENT DOCUMENTS

| | | | |
|---|---|---|---|
| 4,103,382 | 8/1978 | Gitt | 15/104 A X |
| 4,107,811 | 8/1978 | Imsande | 15/104 A X |
| 4,143,194 | 3/1979 | Wihksne | 15/215 X |
| 4,559,250 | 12/1985 | Paige | 15/215 X |
| 4,663,903 | 5/1987 | Ellingson Jr. | 15/215 X |

FOREIGN PATENT DOCUMENTS

| | | | |
|---|---|---|---|
| 17601 | 9/1894 | United Kingdom | 15/215 |

*Primary Examiner*—George F. Lesmes
*Assistant Examiner*—D. R. Zirker
*Attorney, Agent, or Firm*—Pretty, Schroeder, Brueggmann & Clark

[57] ABSTRACT

A contamination control mat configuration and tool for removing sheets therefrom provide for more effective and efficient removal of contamination control sheets. The shape of the mat has a perimeter defining a closed plane figure having an axis extending in a direction about which the closed plane figure is substantially symmetric. The figure has at least one converging portion at an end of the closed plane figure converging toward and terminating adjacent the tab wherein the tab extends away from the figure substantially in the same direction as the axis. The tool is a roller having a rotatable roller bar supported by a bracket and handle and further including an apparatus for applying an adhesive to the roller bar.

11 Claims, 3 Drawing Sheets

CONTAMINATION CONTROL MATS AND METHODS AND APPARATUS FOR REMOVING SHEETS THEREFROM

FIELD OF THE INVENTION

The present invention relates to the shapes of contamination control mats and methods and tools for removing individual layers from such mats.

BACKGROUND OF THE INVENTION

Contamination control mats are common in medical, nuclear, and semiconductor chip manufacturing applications and also in waste removal applications such as asbestos abatement. Such mats are distributed by companies such as American Scientific Products under the trademark MICRO-CLEAN and Liberty Industries under the trademark TACKY MAT. The mats are placed on the floor on one side of a door way to a clean room, for example, for removing particulate matter from shoes and from wheels on carts, etc.

The mats are formed of rectangular layered sheets of plastic adhered to one another. Each sheet has an adhesive coated over the top thereof for adhering to the smooth side of the sheet immediately above it. The bottom sheet has an adhesive coat for adhering the mat to the floor. A protective sheet covers the top sheet of the mat until it is ready for use, when it is removed to expose the adhesive on the first sheet of the mat. The adhesive removes and binds any lose particulate matter on footwear as people walk across the mat. When the top-most sheet becomes contaminated, the sheet is removed to expose a new, adhesive coated sheet. A mat may have 20 or 40 individual sheets. Contamination control mats are referred to in U.S. Pat. Nos. 4,107,811, 4,143,194 and 4,559,250.

Removal of a contaminated sheet from the mat is easier where one or more corners of the sheet is not adhesive. A thin film may be placed over the adhesive on the corner so that the corner does not adhere to the adjacent layer. Alternatively, a corner of the mat may have the adhesive omitted from it entirely during the manufacturing process, thereby forming the non-adhesive corner. A sheet is removed by lifting one or more corners of the sheet and peeling the sheet back. The actual removal of the sheet can be done in several ways, depending on the practice of the person removing the sheet. For example, the sheet can be removed in one quick movement and then wadded up and discarded. Alternatively, it may be wadded up as it is being removed.

Removal of the sheets by current methods causes vibrations in the sheet, causing particulate matter to be dislodged from the sheet and to become airborne. Wadding of the sheet may also produce "airbornes". Contamination of the technicians' hands and clothing is also possible from current methods of removal. In the medical industry, this contamination may be bacterial or viral contaminants getting into the technician's hands or clothing. In the nuclear industry, this contamination will be radioactive particles. Moreover, because of the wadding of the sheets, contaminated sheets take up a significant volume for disposal. Removal of sheets by hand may also result in tearing of the sheet if, for example, there are defects in the sheet.

There is a need for a mat configuration and an apparatus and method for removing separate sheets of contamination control mats which allows removal and disposal of contaminated sheets in a more effective and efficient manner.

SUMMARY OF THE INVENTION

The present invention is embodied in a mat configuration and an apparatus and method to more effectively remove and dispose of individual sheets from contamination control mats without appreciable creation of airbornes and contamination of clothing, skin or other surfaces. The mat, and therefore each individual sheet, is shaped to have an axis extending in a given direction about which the mat is substantially symmetric, and at lease one converging portion at an end of the mat converging toward and terminating adjacent a tab wherein the tab extends away from the mat substantially in the same direction as the axis. The tab forms a non-adhering portion of the sheet so the portion does not adhere to an adjacent sheet. The tab allows easy attachment to a roller so that an individual sheet can be rolled onto a roller, thereby eliminating the need to pull the sheet away from the mat by hand and to wad it up. The tab extends away from the body portion so that rolling up of the tab and the adjacent sheet material occurs before rolling up the wider part of the sheet.

In one form of the invention, the shape of each sheet is defined partly by first and second opposite sides and a bottom edge wherein the tab is positioned on a fourth side between the first and second opposite sides such that the distance from the tab to the bottom edge is greater than the length of at least one of the first and second opposite sides. In a further embodiment, the tab may be located equidistant between the first and second opposite sides so that the tab extends away from the rest of the mat. Also, tabs may be placed at opposite ends of each sheet so that removal of a sheet may be started at either end.

The roller has a rotatable roller bar supported by a handle and means for coupling the handle to the roller bar. The apparatus also includes means for attaching the roller bar to the tab on the top sheet of the contamination control mat so that, when the roller is pushed so that the roller bar rotates over the single sheet, the sheet is peeled away from the remaining layers and wrapped about the roller bar. When the sheet is completely removed, the sheet is entirely wrapped around the roller bar with the adhesive layer containing the contaminants facing the roller bar, trapping the contaminants between the sheet and the roller bar. The roller provides uniform separation of individual layers, minimizes vibration in the sheet and minimizes contamination of the hands and clothing and other surfaces. The roller can be used repeatedly until the cumulative thickness of the sheets around the roller prevents easy use of the tool. The roller bar and rolled sheets can then be disposed of quickly and efficiently, a new roller bar being substituted for the old one.

Further advantages and characteristics of the invention will be become apparent upon consideration of the drawings and the detailed description of the preferred embodiments.

DETAILED DESCRIPTION OF THE PREFERRED EMBODIMENTS

Figure 1:
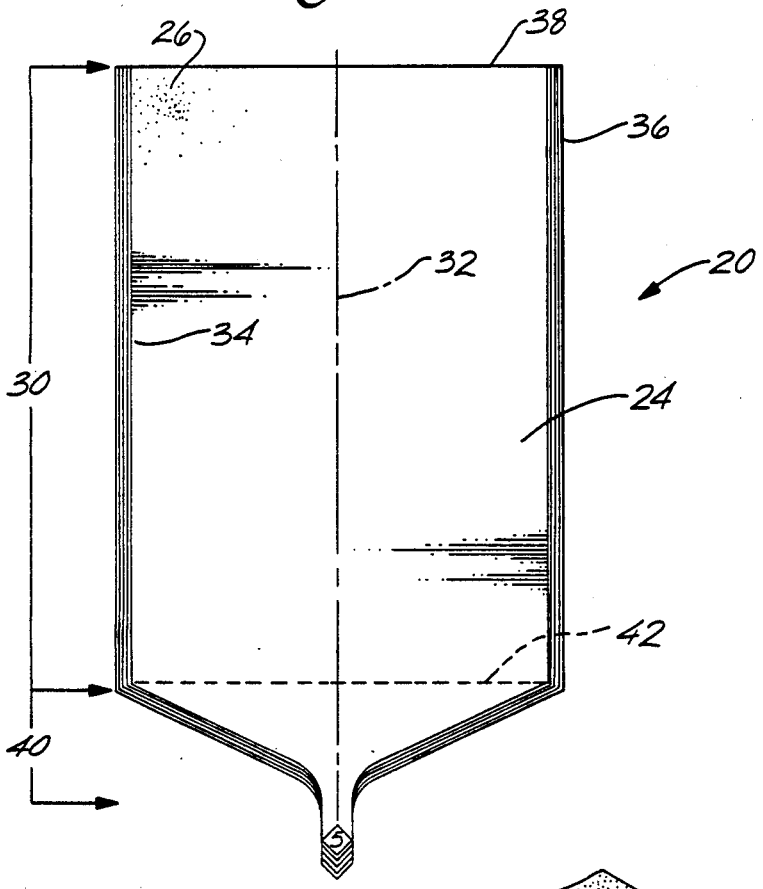
FIG. 1. is a top plan view of a contamination control mat having a configuration according to the present invention.
Figure 2:
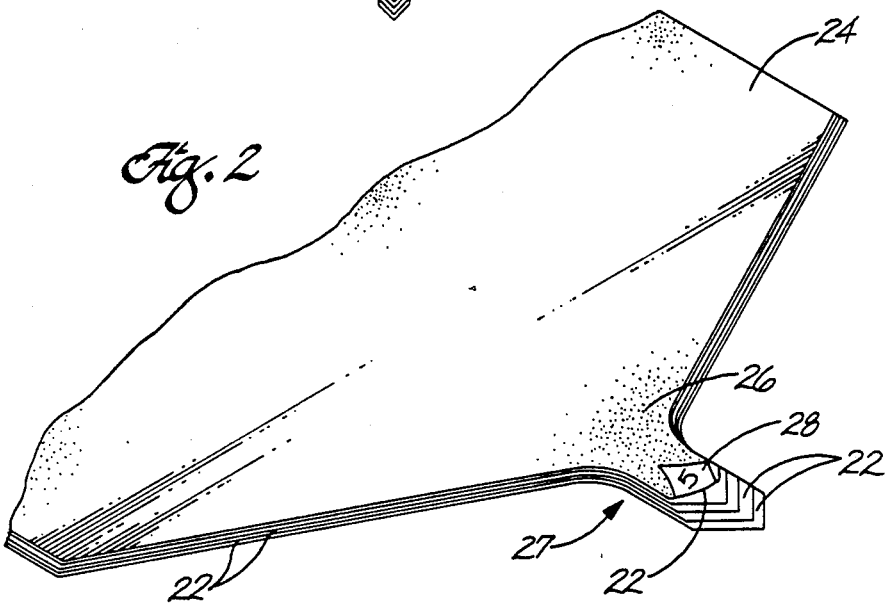
FIG. 2. is a perspective and partial cutaway view of the contamination control mat of FIG. 1.

With reference to the illustrative drawings and particularly to FIGS. 1-2, there is shown and embodiment of a contamination control mat shaped to allow easy attachment of an individual sheet to a roller so that the sheet can be rolled onto the roller, thereby more efficiently and effectively removing and disposing of individual sheets from the mat. A contamination control mat 20 has the standard composition of adjacently adhered sheets 22 of film, each sheet having an adhesive coated over a substantial portion of the upper surface 24 of each sheet. When the separate sheets are layered together, the adhesive serves to adhere adjacent layers to one another. When the adhesive on a particular sheet is exposed by removing the adjacent upper sheet, the adhesive removes particulate matter from shoes, cart wheels, etc. The adhesive is represented at 26, though not all portions of the top sheet which has adhesive is illustrated as having adhesive.

Each sheet includes a projection or strip 27 terminating in a tab 28, which forms a nonadhering portion of the sheet so that the end of the strip does not adhere to an adjacent sheet. As seen most clearly in FIG. 2, each sheet includes a diamond-shaped tab formed by placing a diamond-shaped thin film over the adhesive on the end of the respective strip. In the illustrated embodiment, the end of the tab 28 is pointed so that the shape of one end of the thin matches the shape of the end of the strip on each sheet. Alternatively, the non-adhesive tab may be formed by omitting adhesive from that end of the strip during the manufacture of the sheet. The ends of the strip of each sheet are preferably slightly bevelled or stair-stepped, one from the other, as is the entire perimeter of the mat. The thin film may be colored and numbered so that the number of sheets remaining on the mat can be easily determined by looking at the tab of the top-most sheet. The strip 27 provides a length of small surface area sheet which can be used to initiate separation of the top sheet from the rest of the mat. The nonadhesive portion also helps to initiate separation of the top sheet from the rest of the mat.

When the mat lies substantially flat, as shown in FIG. 1, the perimeter defines a closed plane figure having a body portion 30 having an axis 32 extending in a given direction. The mat is preferably substantially symmetric about the axis. The perimeter is defined in part by first and second opposite sides 34 and 36, respectively, and a bottom edge 38. The term "bottom" is used when referring to the edge 38 of the mat even though it is at the top of FIG. 1 since each sheet of the mat will be rolled up starting from the tab 28 and going toward the bottom edge 38.

The perimeter of the mat includes a converging portion or point 40 converging from the body portion 30 toward and terminating in the tab 28. From the point, the tab extends away from the body portion substantially in the same direction as the central axis 32. The tab is preferably centered between the first and second opposite sides and is positioned adjacent a fourth side 42 extending between the first and the second opposite sides 34 and 36, respectively, and is joined to the body porton by the converging portion 40. The fourth side 42 is not a physical separation of the body portion from the point, but serves as a conceptual dividing line between the body portion and the point and tab. Each sheet forming the mat is a continuous film or sheet which is also covered with a continuous coating of exposed adhesive, except for that portion forming the tab 28 which is not exposed. The tab provides a convenient and easily accessible point of attachment for a roller for rolling the sheet onto the roller for disposal. The tab and also the point facilitate separation of the top sheet from the mat. The adhesive in the point produces a reduced resistance to separation of the sheets because of the smaller adhesive surface area in the point.

The point and the tab of the mat can take any number of configurations. For example, the point may be a right triangle so that the tab is aligned with either the first or the second opposite side of the body portion. Additionally, one or more of the edges which connect the tab to the respective opposite side may be straight or curved according to the desired design. One configuration may be able to fit better in a confined area, while another configuration may be more efficient to manufacture. One configuration may have significant material cost savings over another. The point may have a bottle-nose configuration terminating in a round tab or may terminate in a truncated or square end so that the tab has a flat end. In either case, the point and tab is a narrower section of the sheet than all or most of the body portion, thereby offering less resistance to separating the top sheet from the mat.

Figure 3:
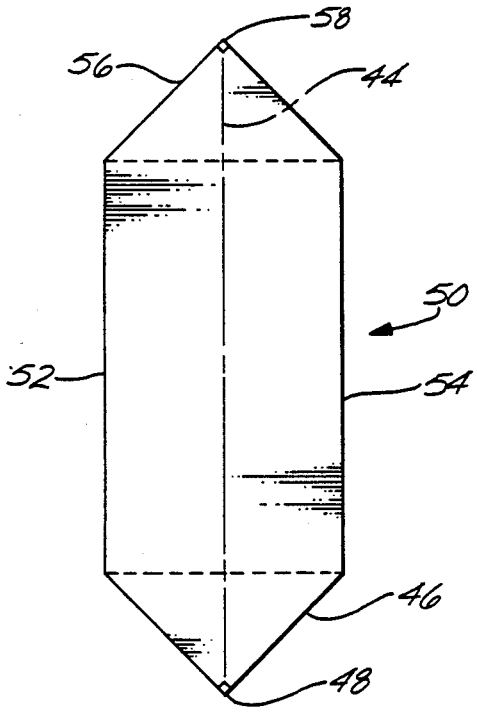
FIGS. 3-6 are schematics and plan views of further configurations of contamination control mats according to the present invention.

FIG. 3 shows a further embodiment of a mat having a central axis 44 extending in a given direction about which the mat is substantially symmetric. The mat includes a first converging portion or point 46 converging toward and terminating adjacent the tab 48. The mat includes a body portion 50 and the tab 48 extends away from the body portion substantially in the same direction as the central axis 44. The mat of FIG. 3 includes first and second opposite sides 52 and 54, respectively and a bottom edge 56.

In a preferred embodiment, and as shown in FIG. 3, the bottom edge 56 converges to a second point and includes a tab 58 at the point so that there are two opposite tabs on the mat. In the preferred embodiment, the first and second points 46 and 56, respectively, and the tabs 48 and 58, respectively, are mirror images. The second point defined by the bottom edge 56 has the same structure and function as the first point 46 and tab 48.

As can be seen in FIG. 3, there are two possible axes of symmetry. The other possible axis is perpendicular to the axis 44, however, the axis 44 is longer and would be the preferred direction for rolling up a sheet from the mat. By rolling up a sheet in the direction of the axis 44 using a roller, a narrower roller can be used than would be necessary if the mat were rolled up in a direction perpendicular to the axis 44. It is preferred to place the tabs 48 and 58 on the axis of symmetry so that the resistance to removal of a sheet by a roller centered on a tab is balanced or centered on the roller and along the axis 44. As previously discussed with respect to FIG. 1, the shapes of the first and second points and tabs can take any number of configurations. The converging portions may be rounded, truncated, bottle-nosed, or off-center from the axis 44.

As an alternative variation to the mat of FIG. 3, a mat (not shown) may be configured having a pair of oppositely directed points where the tab on one point is aligned with the first opposite side and the tab on the opposite point is aligned with the second opposite side. In this configurtion, there is no axis of symmetry, however. As with FIG. 3, the converging portions may be truncated or rounded. In a further variation of the mat shown in FIG. 3, the converging portions may be formed so that the opposite tabs may be both aligned with the first opposite side or with the second opposite side.

Figure 4:
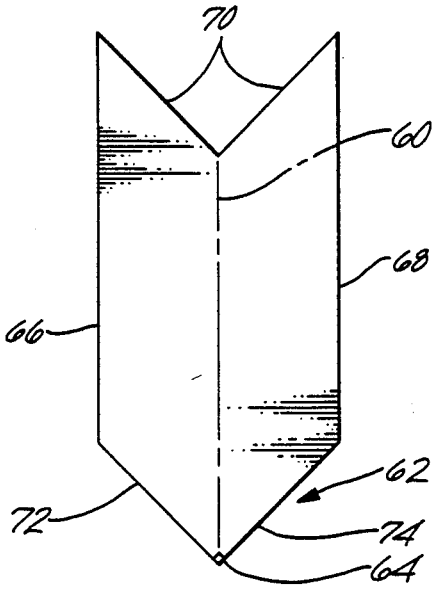

FIG. 4 shows a further embodiment of a mat according to the present invention having a central axis 60 about which the mat is substantially symmetric and a converging portion or point 62 converging toward and terminating adjacent a tab 64 which extends away from the mat substantially in the same direction as the central axis. The mat has first and second opposite sides 66 and 68, respectively, and a bottom edge 70. The tab extends away from and opposite the bottom edge and is approximately equidistant between the first and second opposite sides. The converging portion includes a first edge 72 and a second edge 74 extending between the tab and the first and second opposite sides, respectively. This configuration of a mat has advantages similar to those previously discussed but each sheet is intended to be rolled up in only one direction, namely from the tab to the bottom edge. However, this configuration has the additional advantage that the converging portion 62 compliments the bottom edge 70 so that individual sheets of material can be cut from a continuous roll with less material eosts. As with the other configurations, the converging portion can take several shapes, such as rounded, truncated, and curved. In the preferred embodiment, the configuration of the bottom edge compliments the configuration of the converging portion.

Figure 5:
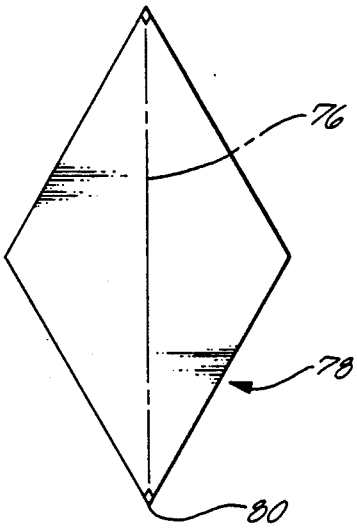

FIG. 5 is a further embodiment of a mat according to the present invention have a central axis 76 and a converging portion 78 converging toward and terminating adjacent a tab 80 wherein the tab extends away from the bottom portion substantially in the same direction as the central axis. This configuration also benefits from the easy and economical manufacture of individual sheets and has a simple configuration.

Figure 6:
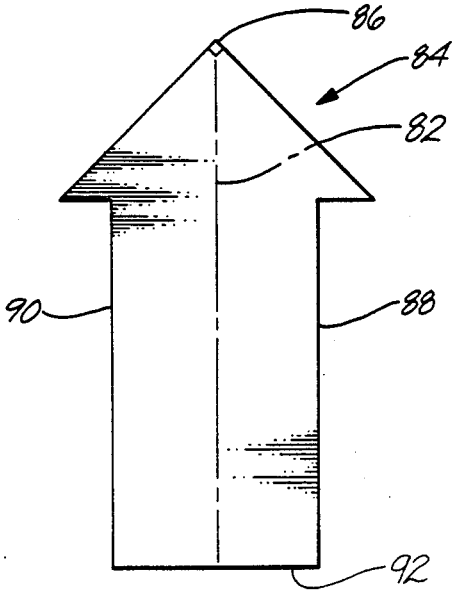

In a further embodiment of a mat, shown in FIG. 6, the mat includes a central axis 82 about which the mat is substantially symmetric and a converging portion or point 84 converging toward and terminating adjacent the tab 86. The tab extends away from the remainder of the mat substantially in the same direction as the central axis. The mat includes first and second opposite sides 88 and 90, respectively, and a bottom edge 92 defining a portion of the perimeter of the mat. The point includes additional edges defining the remainder of the perimeter extending between the first and second opposite sides and the tab. The configuration of the mat in FIG. 6 has an additional advantage of providing directional information since the point is in the shape of an arrow point. In an additional embodiment, the mat can have a pair of oppositely directed arrow points. As with the previously described mats, the mats of FIGS. 5 and 6 can have different configurations by rounding or truncating the converging portions.

As further embodiments, the mat can be configured as a circle having a short converging portion and with a strip, such as that shown in FIG. 1, terminating in a tab. Alternatively, the mat can take the configuration of an elipse or an oval with the tab being located at one or both ends of the long axis of the ellipse or oval.

Figure 7:
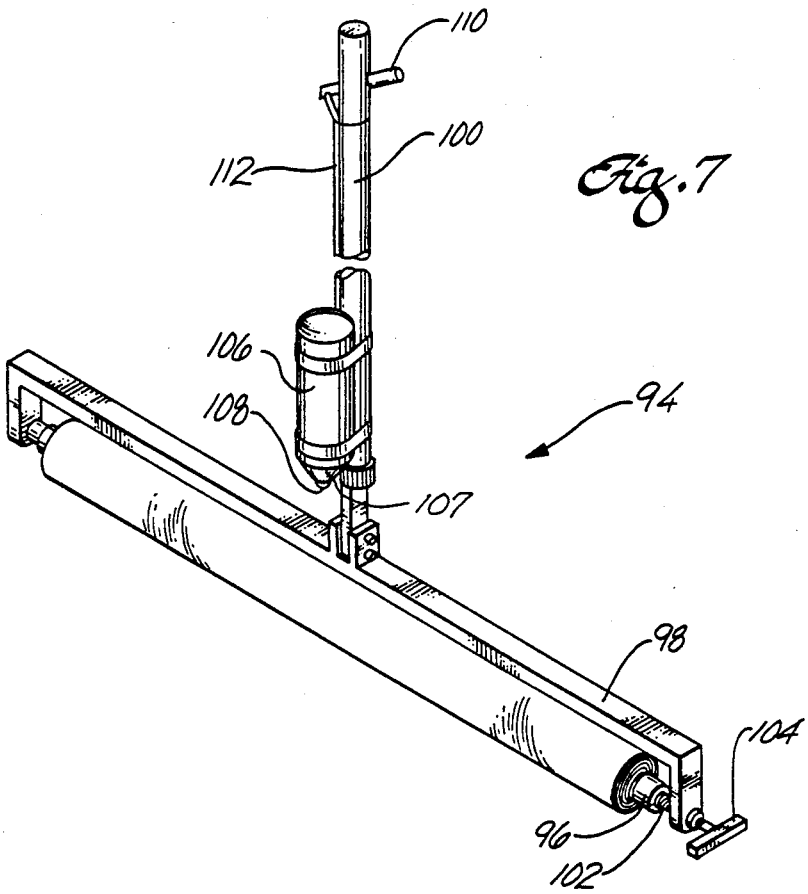
FIG. 7 is a perspective view of a tool for use in removing sheets from contamination control mats according to the present invention.

With reference to FIG. 7, there is shown a tool for more effectively and efficiently removing and disposing of contamination control sheets from a mat. The tool is preferably a roller 94 having a roller bar 96 supported at each end by a U-shaped bracket 98. The bracket is attached to a handle 100.

The roller bar is preferably a plastic roller to minimize creation of airbornes through frictional engagement of the bar with the bracket. In the illustrated embodiment, the roller bar has holes formed in the ends thereof for accepting respective pins extending from he ends of the bracket. One end of the bracket includes a plastic sleeve around the corresponding pin to act as a bearing surface between the end of the roller and the corresponding end of the bracket. This allows the roller to freely rotate around the pin with minimal friction. At the other end of the bracket of the disclosed embodiment, the pin is axially movable and biased inward into the corresponding hole in the roller bar by a coil spring 102. The coil spring is contained at one end by the inside surface of the end of the bracket and at its other end by a washer fixed to the pin. A floating plastic bushing is placed between the fixed washer and the roller bar. The pin is linked to a handle on the other side of the bracket from the coil spring to allow the pin to be retracted from the roller bar allowing the roller bar to be removed from the bracket and discarded. However, other means for removing the roller are possible such as a lever to retract the pin or spreading the bracket to allow the roller bar to fall out.

In the preferred embodiment of the tool, the bracket may be extendable to accommodate varied lengths of roller bars, preferably keeping the handle centered on roller bar. For example, the cross-piece of the bracket may be formed from two pieces which telescope one within the other and which can be locked by an appropriate fastener to hold the roller bar. Additionally, the bracket and handle may be collapsible so that the roller can be broken down and the bracket placed along side the lower end of the handle for storage. This may be accomplished by a locking pivot engagement between the handle and the bracket.

In the preferred embodiment, means are provided on the roller for attaching the sheet on a mat to the roller bar. In the disclosed embodiment, a container 106 is fixed to the handle 100 for slidably holding an adhesive canister 107 near the bottom of the handle. The adhesive canister includes an appropriate applicator 108 for applying an appropriate adhesive onto the roller bar, or onto the exposed surface of the sheet which is wrapped around the roller bar, so that the tab and adjacent sheet material of a contamination control sheet can be adhered to the roller bar. The applicator may be in the form of a roller ball in the end of the canister or on adhesive stick. An actuator 110 is linked to the canister 107 through an appropriate linkage 112 to allow the technician to activate the applicator. In a preferred embodiment, the canister is slidable out of the container 106 along the handle 100 to allow the stick or applicator to advance to apply adhesive to the roller bar, for example, while it is rotating, and then to retract back into the container until the next application of adhesive is required.

Figure 8:
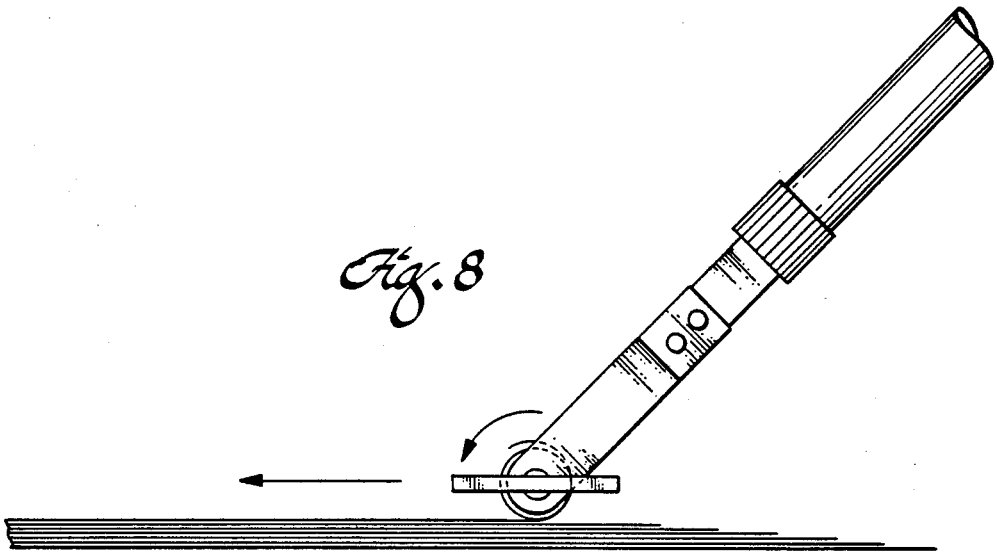
FIG. 8 is a side elevation view of a tool starting to roll up a sheet about a roller bar on the tool.

The steps in using the tool shown in FIG. 7 will be considered, with reference to FIG. 8, in conjunction with the mat configuration of FIG. 1. The means for attaching the sheet to the roller is omitted from FIG. 8 for simplicity. When a top sheet of the mat has been contaminated sufficiently to require removal, the adhesive from the adhesive canister 107 is applied onto the center of the roller bar by activating the activator 110 to slide the adhesive canister foward. Adhesive may be applied onto one location on the roller bar or, alternatively, adhesive may be applied onto the roller bar while the roller bar is being rotated. After retraction of the canister, the roller bar is then centered along the central axis 32 (FIG. 1) downstream-wise fromt the tab 28. When the roller bar contacts the sheet, the roller is pulled backward toward the tab so that some adhesive is layed down on the sheet between the first contact point of the roller bar on the sheet and the tab. The backward movement of the roller bar is stopped at the tab to allow the tab to adhere to the roller bar. When the tab is sufficiently adhered to the roller bar for the roller bar to wrap the sheet around the roller bar, the roller bar is pushed forward along the top of the sheet rolling the sheet around the roller bar as it turns.

As the roller bar moves along the sheet towards the body portion of the sheet, the width of the sheet contacting the roller bar increases. Consequently, the force necessary to separte the upper sheet from the mat increases until the widest point of the sheet is reached. Thereafter, the resistance caused by the adhesive is essentially constant unless the cross-sectional area of the sheet changes, if at all. However, since the sheet has already rolled several times around the roller bar, the force applied to the handle of the roller is distributed across the width of the roller bar and therefore the sheet so that the possibility of tearing the sheet is minimized. Moreover, because the adhesive layer on each sheet is uppermost, the adhesive coat contacts and adheres to the roller bar as each segment of the sheet wraps around the bar. This serves several functions. First, actual attachment or adherence occurs between the sheet and the bar so that the bar does not slip along the sheet. Additionally, the combination of rotation of the roller and adhesion of the sheet to the roller bar assists in overcoming the adhesive contact between the upper sheet and the next lower sheet. A further advantage is that the contaminants which are on the sheet being removed are trapped between the sheet and the roller bar as the sheet is being rolled up. This minimizes the possibility that airbornes will be created by any possible vibration as the sheet is being removed. Additionally, by wrapping the sheet around the roller bar, each sheet is removed and stored on the bar neatly until the roller bar is disposed of, in contrast to the hand method of wadding the sheet up and placing it in a bag. When the effective diameter of the roller bar increases due to the multiple layers of sheets, the roller bar can be removed by pulling on the handle 104 to disengage the roller bar from the pins. The bar and the accompanying sheets can then be disposed of as necessary.

It should be noted that in FIG. 8, the inter-sheet separation between individual sheets and between the tabs of the mat is exaggerated. Additionally, the tab of the top layer is shown spaced from the surface of the roller for clarity. However, it should be understood that the adhesive applied to the roller causes the tab to adhere to the surface of the roller. It should be noted that the length of the ends of the bracket will determine the number of sheets that can be accommodated on a given roller bar before the roller bar must be removed. Preferably, 40 sheets can be wrapped on the roller bar before it needs to be replaced.

Where there is more than one possible axis of symmetry for a given mat configuration, the tabs are preferably oriented at the end of the longest or major axis of the mat. This allows a narrower roller bar to be used to roll up the sheets. However, it should be noted that it is not necessary that the center of the roller bar trace over the central axis of the mat as the roller is pushed over the mat, but it is preferable so that rolling up of the sheet is balanced. Moreover, the mat is preferably symmetric about a center axis so that the resistance created by the adhesive is balanced or centered along the axis.

If the tab were not centered relative to an axis of symmetry of the mat, the tool could either be centered on the tab in which case there would be more resistance to removal of the sheet on one side of the tab than another, or the tool can be centered on the mat, in which case attachment of the tab and initial separation of the sheet would not be centered on the roller bar. This may make removal of the sheet more difficult than if the tab were centered on the mat. Therefore, symmetry provides an easy and efficient method of removing individual sheets. It also provides for more efficient manufacture and use of material for the mats.

In summary, the mat configuration and tool provide apparatus and a procedure which results in a more efficient and effective method of removing and disposing of contaminated sheets from contamination control mats. The mats are shaped so as to facilitate attachment of a tab on the mat to a roller bar and rolling of the sheet about the roller bar to remove and dispose of the sheet. When removal of a sheet is started, the resistance due to the adhesion of the top sheet to the mat is a minimum because of the convergent sheet portion adjacent the tab.

Although the present invention has been described in detail with reference only to the present preferred embodiments, it will be appreciated by those or ordinary skill in the art that various modifications can be made without departing from the spirit of the invention. Accordingly, the invention is limited only by the following claims.

I claim:

1. In a contamination control mat of adjacently adhered sheets of film, each sheet having an adhesive coated over a substantial portion of the upper surface of each sheet and a tab forming a non-adhering portion of the sheet that does not adhere to an adjacent sheet, wherein the mat has, when lying substantially flat, a perimeter defining a closed plane figure, the improvement wherein the closed plane figure has an axis extending in a given direction about which the closed plane figure is substantially symmetric, and at least one converging portion at an end of the closed plane figure converging toward and terminating adjacent the tab wherein the tab extends away from the figure substantially in the same direction as the axis.

2. The mat of claim 1 wherein the closed plane figure includes a body portion having first and second parallel opposite sides and a bottom edge and wherein the converging portion terminates in a strip portion connecting the converging portion and the tab.

3. The mat of claim 2 wherein the body portion is rectangular and wherein the tab is substantially equidistant between the first and second sides.

4. The mat of claim 3, wherein the bottom edge comprises a further converging portion and tab substantially equidistant between the first and second sides.

5. The mat of claim 1 wherein the closed plane figure includes a body portion having first and second parallel sides and wherein the converging portion comprises first and second sides meeting at a point at the tab.

6. The mat of claim 5 further comprising a bottom edge having first and second sides converging to a point in the same direction as the point of the tab.

7. The mat of claim 6 wherein the first and second sides of the converging portion and of the bottom edge are straight sides.

8. The mat of claim 5 wherein the body portion includes a bottom edge having first and second sides converging to a point at a tab.

9. A contamination control mat of layers of adjacently adhered sheets of film, each sheet having an adhesive coated over a substantial portion of the upper surface of each sheet and a tab forming a non-adhering portion of the sheet that does not adhere to an adjacent sheet, wherein the mat has, when lying substantially flat, a shape defined partly by first and second substantially opposite sides and a bottom edge, the improvement wherein the tab is positioned adjacent a fourth side between the first and second opposite sides and extends away from the bottom edge such that the shortest distance from the tab to the bottom edge is substantially greater than the length of at least one of the first and second opposite sides.

10. The mat of claim 9 wherein the first and second sides and bottom edge define part of a rectangle and wherein the mat further includes a converging portion between the tab and the first and second sides.

11. A contamination control mat of layers of adjacently adhered sheets of film, each sheet having an adhesive coated over a substantial portion of the upper surface of each sheet and a tab forming a non-adhering portion of the sheet that does not adhere to an adjacent sheet, wherein the mat has, when lying substantially flat, a shape defined partly by first and second opposite sides and a bottom edge, the improvement wherein the first and second opposite sides and the bottom edge define three sides of a rectangle, wherein the shape is further defined by third and fourth straight edges converging respectively from the first and second opposite sides to the tab wherein the tab extends away from and opposite the bottom side and approximately equidistant between the first and second opposite sides.

* * * * *